United States Patent [19]

Wilentchik

[11] 3,971,903

[45] July 27, 1976

[54] MULTI SLIDER SWITCH

[76] Inventor: Jerzy J. Wilentchik, 222 Lake Ave., Yonkers, N.Y. 10701

[22] Filed: Nov. 25, 1974

[21] Appl. No.: 526,908

[52] U.S. Cl. ..... 200/16 C
[51] Int. Cl.[2] ..... H01H 15/06
[58] Field of Search ..... 200/16 C, 16 D, 276, 200/293–296

[56] References Cited

UNITED STATES PATENTS

| | | | |
|---|---|---|---|
| 3,223,794 | 12/1965 | Hoy et al. | 200/16 C |
| 3,308,250 | 3/1967 | Field et al. | 200/16 D |
| 3,327,278 | 6/1967 | Godel | 317/112 X |
| 3,639,706 | 1/1972 | Purdy | 200/276 X |
| 3,652,813 | 3/1972 | Davis | 200/16 D |
| 3,705,963 | 12/1972 | King et al. | 200/16 C |
| 3,729,600 | 4/1973 | Solomon et al. | 200/16 D |
| 3,735,059 | 5/1973 | Glaser et al. | 200/16 C |
| 3,772,486 | 11/1973 | Wilentchik | 200/16 C |

*Primary Examiner*—James R. Scott
*Attorney, Agent, or Firm*—Temko & Temko

[57] ABSTRACT

A bank of PC board mounted low-power electric switches applicable to variety of functions is packaged in a common enclosure. The switches have a common matrix but are controlled independently of each other by respective sliders displaceable due to space limitations by pointed objects.

20 Claims, 15 Drawing Figures

MULTI SLIDER SWITCH

BACKGROUND OF THE INVENTION

There are known in the art miniature butt-contact programming switches packaged in a common enclosure yet operated independently of each other.

The butt-contact arrangement provides for a pair of conductors being brought into physical engagement or moved away from each other by a purely mechanical means. The conductors have little resilience, therefore, the amount of physical force necessary for holding them together under conditions of normal usage, including shock and vibration is substantial. In a miniature switching device, the amount of force that can be applied is, however, limited, resulting in unreliable electric performance.

Butt-contact switches in the art are limited to "on-off" functions and are difficult to adjust by human fingers due to miniature size. They have also life expectancy limited to 2,000 cycles. Another disadvantage is that two conventional switches when placed side to side occupy more space than a single switch controlling equal number of circuits.

SUMMARY OF THE INVENTION

My invention overcomes all the aforementioned difficulties encountered in existing programming switches by:

1. Providing true wiping contact in lieu of butt-contact for more reliable performance and for longer life.
2. Providing means for operating the switch by objects other than human fingers.
3. Expanding the scope of application from single pole, single throw to multi-pole, multi-throw and selector functions.
4. Providing open frame construction to permit placing of several switches side to side without loss of useful PC board space as compared to a single switch with equal number of sliders.

My invention is an improvement in part over U.S. Pat. No. 3,772,486 granted the applicant on the 13th day of November, 1973. The U.S. Pat. No. 3,772,486 deals with the application of the "Bridging Spring Contact" to single element selector switches of sliding and rotary design.

The present invention deals primarily with those uses of the "Bridging Spring Contact" to which my former patent is inapplicable.

Specifically, switches described in my U.S. Pat. No. 3,772,486 employ only one slider per switch. The present invention, on the other hand, employs plurality of sliders, each controlling an entirely independent circuit.

A further improvement provides for the use of rivets or eyelets as contact means in lieu of a coil of a helical spring in my U.S. Pat. No. 3,772,486. This decreases considerably switch electrical resistance and increases contact reliability. The multi-slider feature of my present invention is particularly important for printed circuit applications requiring high density component packaging. A standard printed circuit grid provides for 0.1 inch × 0.3 inch hole spacing and is known in the art as "dual in line." It is impossible with discrete switches in the art to meet the requirements of this grid due to space limitations. Open frame multi-slider switch described in my present application overcomes, however, this difficulty.

My invention provides also, means other than human fingers such as pen-point for operating individual sliders. This is necessitated by the miniature size of the sliders which makes their actuation by human fingers on a crowded PC board virtually impossible. Another advantage of multi vs. single slider design is its cost economy as it requires only one enclosure and one matrix board, thus saving as much as 50% of the cost of manufacture. Still another advantage of my invention over the existing art including the U.S. Pat. No. 3,772,486 provides for user etching the matrix of the switch directly on his PC board. The enclosure, the sliders and the springs, less matrix and pins are furnished as separate items to be mounted by user on his PC board and offers the advantages of:

1. Substantial reduction of costs.
2. Elimination of soldering operation by user.
3. Easy replacement by user of worn or defective contact springs.

The invention is described with the aid of the following drawings.

DETAILED DESCRIPTION OF THE DISCLOSED EMBODIMENTS

The invention is described with reference to several embodiments. In the first (FIGS. 1 to 7 and 13) there are several rails with one slider per rail. In the second, (FIGS. 8 and 9), the maximum number of rails is two, with each rail accommodating several sliders. In either case, each of the sliders controls an electrically and mechanically independent switch circuit with matrices of several switches being located on one common baseboard. Further refinements of design provide for ganged sliders to be moved in unison or for one slider to be provided with several wiping springs to control at one time several switch matrices.

Figure 10:
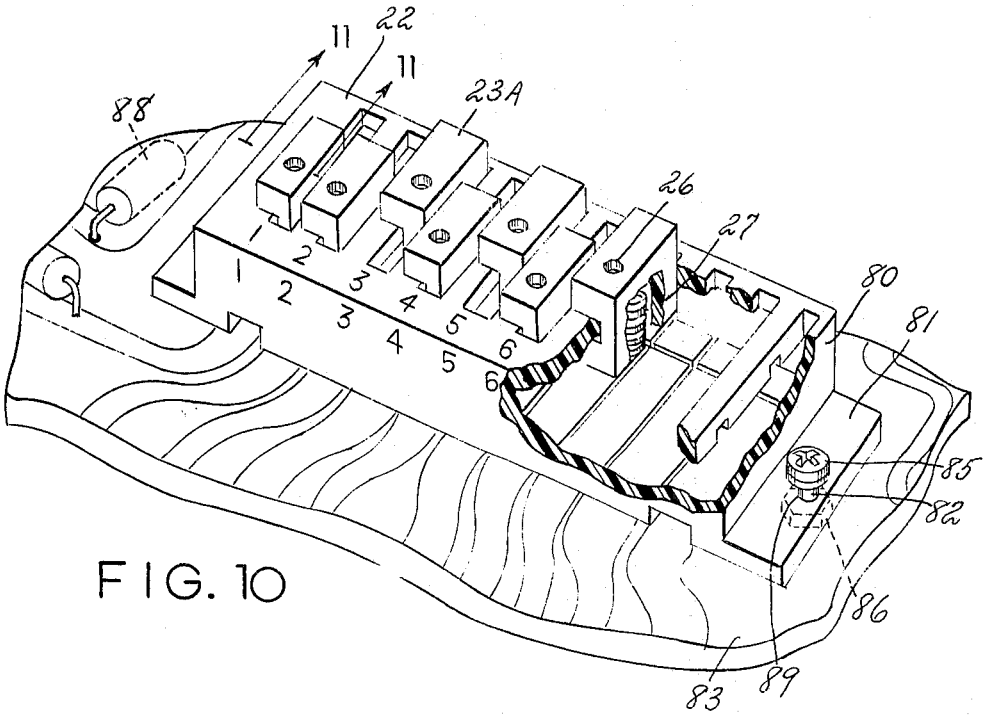
FIG. 10 is a perspective, partly cut away view of a switch embodiment according to FIG. 1 having attachable matrix imprinted on separate PC board on which circuit components other than switches are mounted.
Figure 13:
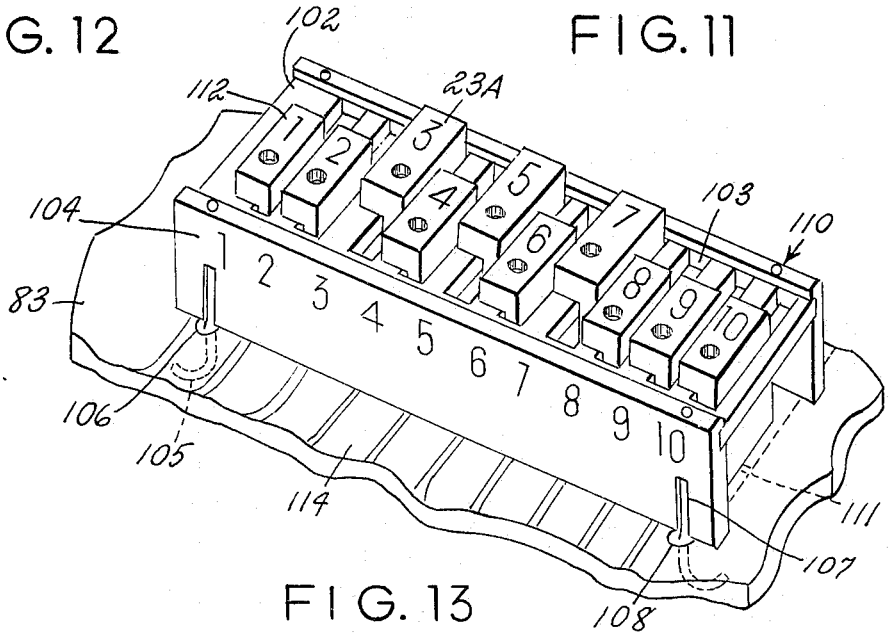
FIG. 13 is a perspective view of a modified embodiment of FIG. 10 according to the invention.

Third embodiment of the invention provides for matrix patterns to be etched on printed circuit boards which are considerably larger than the size required by the switch alone, the boards containing etched connections for numerous circuit components other than switches (FIGS. 10 and 13). The switch enclosures contain sliders and springs and are furnished less baseboards, switch matrices and terminal pins. Means are provided, however, for attachment by user of the enclosures to the P.C. boards.

The wiping contact in my switch is a moveable self-cleaning helical spring bridging over a pair of stationary contacts. The stationary contacts are either tabs imprinted on or laminated to a board or wiping forms individually fastened to a board. This type of construction as compared to butt-contact arrangement offers all the desired characteristics generally encountered in switches of considerably larger dimensions.

Basically, my invention provides a switching device for controlling multiplicity of switch circuits, each switch circuit being composed of at least one first conductor and one second conductor. Both first and second conductors are mounted on a common baseboard, yet separated from each other by a relatively narrow gap of insulation.

Each circuit is controlled by a respective slider carrying spring(s) connecting or disconnecting respective first and second conductors as needed, relative to slider being moved on rails between respective stations.

Switch functions can be single throw, double throw or "selector." In a single throw function, each first conductor can be connected via intermediary of the slider spring to a corresponding second conductor. The slider can assume one of two positions. In "on" position, its spring is stationed astride the gap separating corresponding pair of first and second conductors, thus connecting them electrically. In "off" position, the spring is stationed away from the gap.

In double throw function switches, the slider assumes one of two positions connecting the second conductor to either one or the other one of two first conductors.

In selector function switches, the slider assumes one of several positions, connecting in each position, a single second conductor to one of several first conductors.

Precise positioning of sliders at respective stations is obtained by rigid mechanical stops or by a detent mechanism and a graduated scale.

Figure 1:
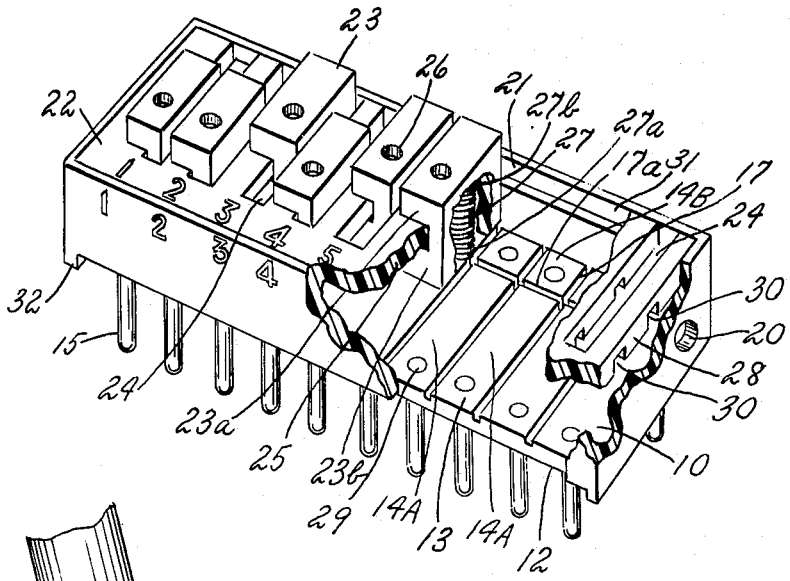
FIG. 1 is a perspective, partly cut away view of a programming, single pole, single throw, closed frame switch employing printed circuit board according to the invention.

The invention is described first in reference to a single pole, single throw embodiment of FIG. 1, showing a rectangle shaped insulating baseboard 12 having a relatively thin layer of conducting metal 13 laminated to one of its larger surfaces 10. The metal 13 is divided by plurality of parallel grooves 17 and by a groove 17*a* at right angle to the grooves 17 into a plurality of contacts 14A and 14B insulated from each other. The grooves 17 and 17*a* extend the entire thickness of the metal 13 to the insulating baseboard 12. Each of the contacts 14A and 14B is provided with an external pin 15 electrically and mechanically joined thereto by solder or by other suitable means (not shown), press-fitted thru respective opening 29 in the baseboard 12. The matrix of each switch is contained between a pair of parallel grooves 17, the number of such grooves determining the number of independent switches in the device. The grooves 17*a* divide the matrix of each switch into two contacts identified by respective subscripts A and B as 14A and 14B.

A rectangle shaped tube 21 having milled edges 31 encloses the baseboard 12 and another similarly dimensioned baseboard 22 with joints being epoxied or otherwise permanently joined together (not shown). The baseboard 22 has a plurality of slots 24 parallel to the grooves 17 and a pair of parallel relatively shallow grooves 30, one of them having its center disposed parallelly and directly vis-a-vis the grooves 17*a*. A ridge 28 separates the grooves 30. Baseboard material between the slots 24 acts as rails for sliders 23 mounted dove-tail fashion in respective slots 24. A groove 25 divides the slider 23 seen better in FIG. 5 into pair of sections 23*a* and 23*b* having a hole 26 thru. A compressed helical, electrically conducting spring 27 having ends 27*a* and 27*b* is inserted into the hole 26 in the section 23*b*, its lower end 27*a* exerting pressure on the metal 13 and its upper end 27*b* on the baseboard 22. The outside diameter of the spring 27 is considerably larger than the width of the grooves 17*a* but smaller than the width or length of individual contacts 14A and 14B or the width of the grooves 30.

The travel of respective sliders 23 is limited at one end by the length of the slots 24 and at the other end by the walls of the tube 21. In the two extreme positions of the slider 23, the spring end 27*b* rests within either one of the grooves 30 and the spring end 27*a* either straddles the groove 17*a*, thus connecting electrically the contacts 14A and 14B or is positoned in the center of the contact 14A away from the groove 17*a*, thus making no electrical connection.

When the slider 23 is moved from one extreme position to the next, the spring 27 is further compressed to permit its end 27*b* to climb over the ridge 28 from one groove 30 to the next one, thus creating detent effect.

The tube 21 may be provided with drain holes 20 for passing PC board cleaning solutions and with moisture barriers 32 used frequently in PC mounted assemblies.

Figure 1A:
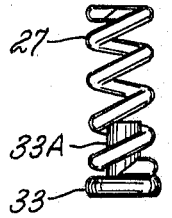
FIG. 1A is a view of the spring with a rivet according to FIG. 1.

Referring to FIG. 1A, it is seen that the spring 27 may be provided with a conductive rivet or eyelet 33 having shank 33*a* inserted by tight push fit into inside diameter of spring's wiping end 27*a* in contact with the metal 13. The rivet 33 may be employed in other embodiments of the invention, shown in subsequent drawings of this specfication, although no direct reference to it is being made. The provision of the rivet lowers the internal resistance of the switch and makes it considerably more stable.

Figure 2:
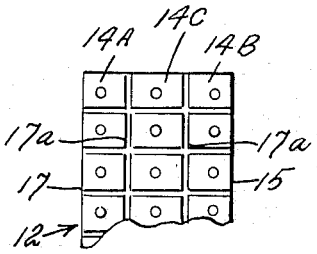
FIG. 2 is a view of the switch matrix employed in a single pole, double throw embodiment of the switch according to FIG. 1.

FIG. 2 shows the matrix of a single pole, double throw switch which can be easily substituted for the contact pattern of FIG. 1 providing two grooves 17*a* instead of a single groove 17*a* in FIG. 1. The grooves 17*a* are located symmetrically with regard to the long edges of the baseboard 12 dividing the copper 13 into three contacts 14A, 14B and 14C, each associated with an individual pin 15. The grooves 17 remain the same as shown in FIG. 1. Since respective grooves 17*a* and 30 are located opposite each other, the spring 27 straddles in its extreme positions either of the grooves 17*a* thus connecting the contact 14C to either the contact 14A or 14B. The rest of the construction remains the same as for a single throw switch arrangement described in reference to FIG. 1 and the operation thereof will be understood by those skilled in the art without further explanation.

Three position, center-off, single pole, double throw switch arrangement utilizing matrix of FIG. 2 can be realized by providing a single groove 30 (not shown) in the center of the baseboard 22 in lieu of two grooves 30 seen in FIG. 1. It is understood that in the off position the spring end 27*b* will rest within the center groove 30. Detent effect is obtained when the spring end 27*b* climbs out of the groove 30.

Figure 3:
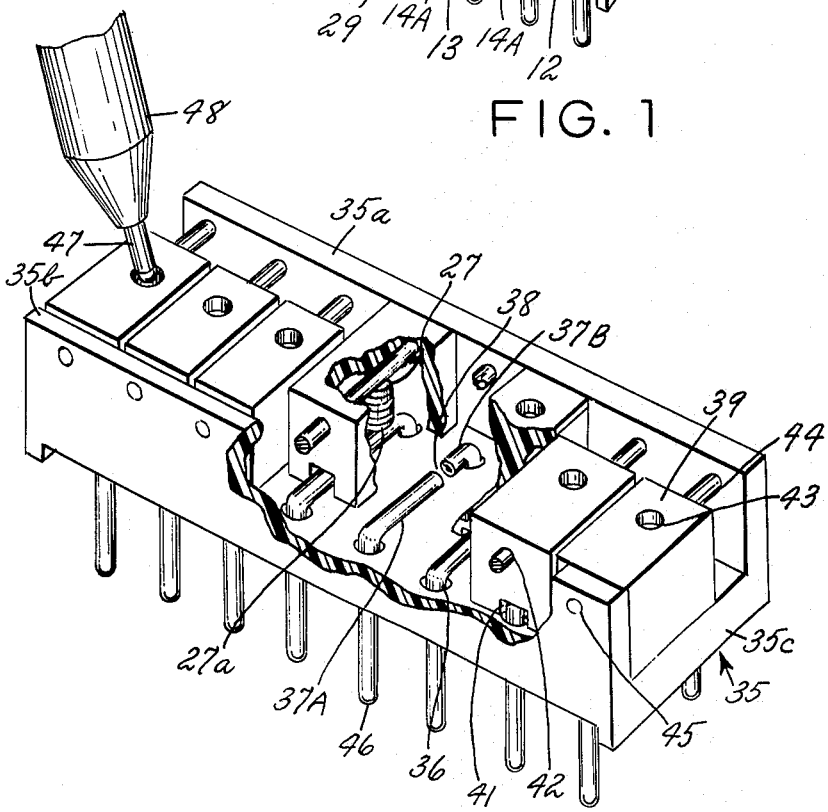
FIG. 3 is a perspective partly cut away view of a programming single pole, single throw, open frame switch employing wire-forms in lieu of the printed circuit tabs according to the invention.

A modified design of a single pole, single throw switch is shown in FIG. 3 and consists of a U-shaped nonconducting structure 35 having a pair of parallel walls 35*a* and 35*b*, and a connecting wall 35*c*, provided with U-shaped metal pins 37 and replacing contacts 14A and 14B and molded in the structure 35 or held in place by epoxy cement and protrude externally thru respective openings 36.

Figure 4:
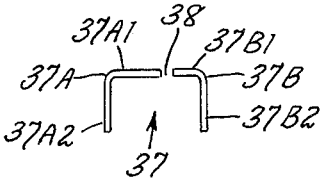
FIG. 4 is a view of the wire-forms according to FIG. 3.

FIG. 4 shows more clearly that each of the pins 37 consists of two L-shaped saw cut pins 37A and 37B. The location and the width of the saw cut 38 between the pins 37A and 37B corresponds to location and width of the groove 17*a* in FIG. 1. It is seen that the pins 37A and 37B have respective sections 37A2 and 37B2 protruding externally from the structure 35 and respective internal sections 37A1 and 37B1. It is also seen that section 37A1 is considerably longer than the section 37B1.

A plurality of sliders 39 functionally similar to sliders 23 of FIG. 1 can be displaced within the structure 35 in a direction parallel to the pin sections 37A1 and 37B1. Each slider 39 has a bottom groove 41 dimensioned to provide a slide fit over respective pin sections 37A1 and 37B1 and a pair of thru holes 42 and 43 at right angle to each other.

Pins 44 are anchored by press fit, cement or other suitable means (not shown) in holes 45 in the walls 35*a* and 35*b*, extend thru the holes 42 and provide sliding support for the sliders 39. It will be seen by those skilled in the art that the sliders 39 when displaced are guided by both the pins 44 and the pin sections 37A1 and 37B1. Springs 27 same as used in the embodiment of FIG. 1 are placed in respective holes 43 between the pins 44 and the pin sections 37A1 and 37B1 and are subject to displacement by the sliders 39. It will be clear to those skilled in the art that when the spring wiping surface 27*a* bridges across the gap 38, an electrical connection is made between the sections 37A1 and 37B1. In this position, the slider 39 is resting against the wall 35*a*.

In the other position, when the slider 39 is banked against the wall 35*b*, the spring wiping surface 27*a* rests on the section 37A1 away from the gap 38 and the switch circuit is open. The sliders 39 may be displaced either manually or by pointed objects such as tip 47 of a ball point pen 48.

The alternating opening and closing of the gaps 38 between adjacent pins 37A and 37B by the spring wiping surface 27*a* provides for a single pole, double throw switch function. It will be understood by those skilled in the art that respective gaps 38 shown staggered in FIG. 6 could be placed without changing principle of operation in the center of the channel 35, and the center of respective pins 37 (not shown), thus making the L pins 37A and 37B of FIG. 4 equal to each other in every respect. In this type of arrangement, the wiping surface 27A will be located in the center of the channel 25 thus closing the gap between the pins 37A and 37B when the slider 39 is banked against the wall 35*b*. The gap will be open, however, when the slider is banked against the wall 35*a*. Thus, individual switches shown in FIG. 3 are closed when respective slider openings 43 are near the wall 35*a*, however, if the gap 38 should be located in the center of the channel 35 then the open position will correspond to the opening 43 being in the center of the channel 35.

It is seen that the switch shown in FIG. 3 is of open frame construction, meaning, that it's two out of six sides are open. This obviates the need for drain holes and permits replacing, without loss of useful PC board space, any multislider switch by an assembly of switches having same number of sliders. As further advantage, a strip comprised of virtually unlimited number of switches can be built out of several units while maintaining the same spacing of pins on the PC board.

Figure 3A:
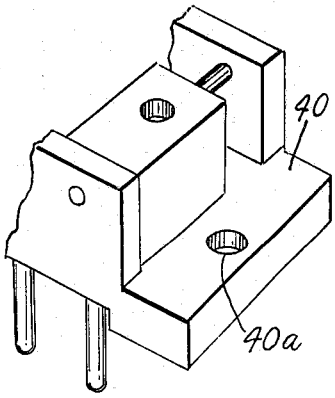
FIG. 3A is a partly cut away view of the switch according to FIG. 3.

Referring to FIG. 3A, it is seen that the structure 35 can be provided at either of its ends with flanges 40 having thru holes 40*a* for mounting the switch by screws (not shown) to a panel (not shown), as against customary mounting by pins soldered to a PC board.

Figure 5:
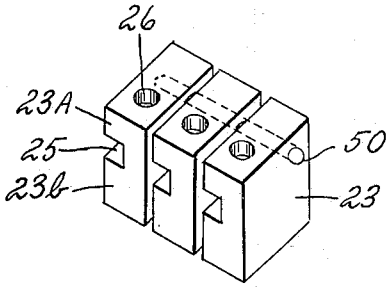
FIG. 5 is a perspective view of an assembly of ganged sliders according to FIG. 1.

Referring now to FIG. 5, several sliders 23 of FIG. 1 may be joined together by means of a pin 50 press fitted in respective holes thru those sliders. This permits simultaneous displacement of several sliders together, thus converting single pole arrangement of FIG. 1 to a multipole operation. It will be understood by those skilled in the art that similar result can be realized by driving a pin 50 thru several sliders 39 of FIG. 3.

Figure 6:
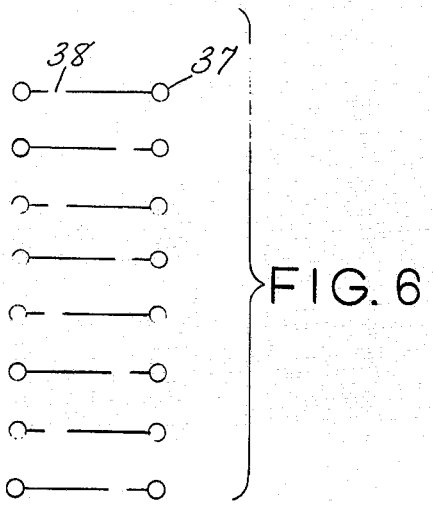
FIG. 6 is a diagrammatic presentation of a single pole, double throw switch matrix according to FIG. 3.
Figure 7:
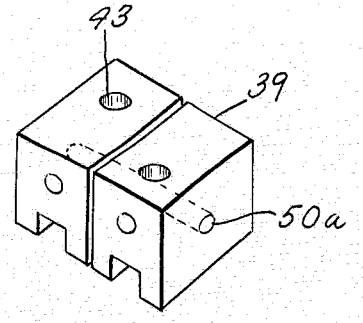
FIG. 7 is a perspective view of a pair of ganged sliders used in conjunction with matrix of FIG. 1.

Referring now to FIGS. 6 and 7, it is shown that the arrangement of FIG. 3 can be used for single pole, double throw functions. It is shown schematically in FIG. 6 that the saw cuts 38 in the pins 37 are staggered symmetrically, one on the left side and one on the right side of consecutive pins 37. The sliders 39 seen in FIG. 7 are joined pairs by means of a pin 50*a* extending thru respective openings in said sliders or by means of cement. The sliders 39 are placed side by side with their sides parallel and aligned, but their openings 43 speced diagonally to each other. It will be clear to those skilled in the art that when a pair of sliders 39 seen in FIG. 7 is placed in the switch of FIG. 3 and pushed towards the wall 35*a*, the gap 38 in one of the pins 37 will be closed by the spring 27 and the other remain open, but when the same pair of sliders is pushed towards the wall 35*b*, the situation will reverse and the gap 38 in the next pin 37 will be closed while the first is opened.

Figure 8:
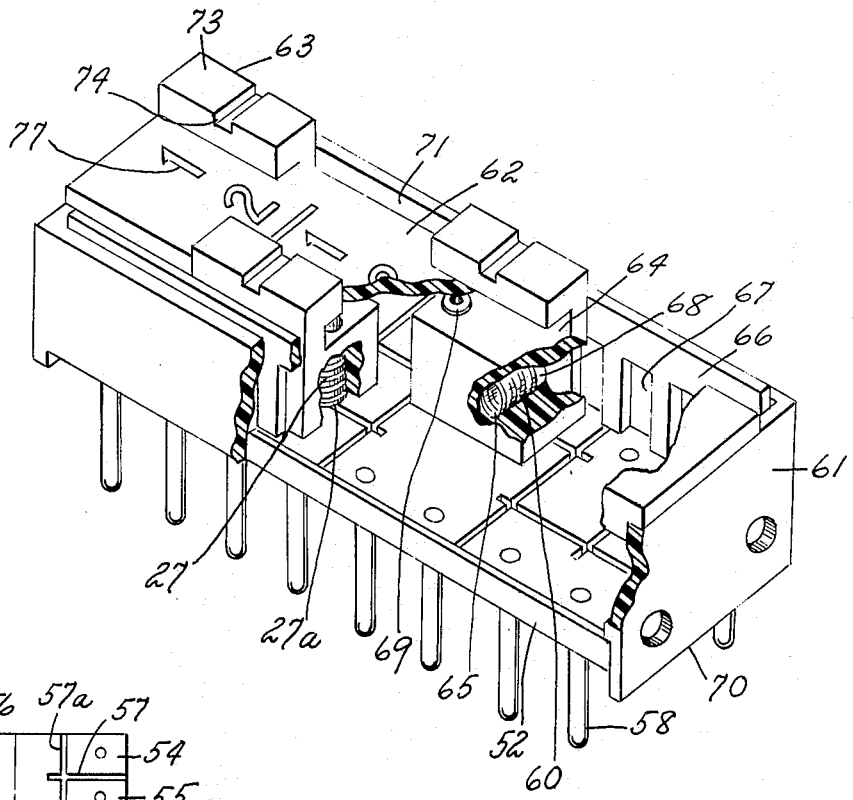
FIG. 8 is a perspective partly cut away view of a single pole, double throw switch according to the invention.
Figure 9:
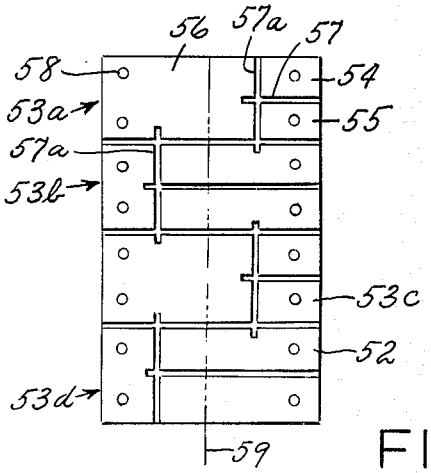
FIG. 9 is a view of switch matrix according to FIG. 6.

Referring now to FIG. 8, there is shown a modified design of a single pole, double throw switch employing a baseboard 52 similar to the baseboard 12 except that its matrix pattern consists of four separate contact areas 53*a*, 53*b*, 53*c* and 53*d* seen in more detail in FIG. 9. Each contact area comprises three separate contacts. Thus, the contact area 53*a* comprises a pair of contacts 54 and 55 on the right, separated from each other by a groove 57 and of a common contact 56 on the left separated from the contact 54 and 55 by groove 57*a* analogous to the groove 17*a*. It is understood that when a bridging spring contact 27 identical to the one explained in reference to embodiment of FIG. 1 is placed astride the groove 57*a* at the center of the contact 54, the contacts 54 and 56 are connected electrically together by the spring wiping surface 27*a*.

When the wiping spring 27 is moved astride the groove 57*a* to the center of the contact 55, the contacts 55 and 56 are connected together. Each of the contacts 54 and 55 is provided with an externally protruding pin 58, similar to pin 15 in FIG. 1. The contact 56 has two pins 58 arranged symmetrically to the pins 58 associated with the contacts 54 and 55, although only one pin 58 is needed for connecting the outside voltage source. It is seen that the contact areas 53*a* and 53*c* are identical to the contact areas 53*b* and 53*d*, except for location of the groove 57*a*. The groove 57*a* is located to the left of the center line 59 for the areas 53*b* and 53*d* and the same distance to the right of the center line 59 for the areas 53*a* and 53*c*. Referring back to FIG. 8, the baseboard 52 is a part of a six sided rectangle shaped enclosure 70 comprised of a four sided tube 61 and a cover 62, all sides held together by epoxy cement or by other suitable material.

The cover 62 is narrower than the width of the enclosure 70 leaving gaps 71 on either side thereof for mounting sliders 63. The long edges of the cover 62 support four sliders 63 controlling respective contact areas 53*a*, 53*b*, 53*c* and 53*d*. The sliders 63 have grooves 64 for mounting dovetail fashion on the edge of the cover 62 and are provided with holes 69 housing springs 27, identical to those shown in FIG. 1, the latter displacement along respective grooves 57*a*. A pair of detent plates 66 mounted along the long sides of the tube 61 parallelly to the cover 62 permits stationing by hand of the slider springs 27 at respective centers of the contacts 54 and 55. The plate 66 has uniformly spaced rectangle shaped cutouts 67 engaged by a spring loaded ball 68 in each of the sliders 63. For that purpose, the slider 63 is provided with a hole 65 at right angle to the hole 69, housing helical spring 60 and ball 68. The diameter of the ball 68 is slightly larger than the width of the cutouts 67 and slightly smaller than the diameter of the holes 65. It will be clear to those skilled in the art that as the slider 63 is displaced along the long edge of the cover 62, the ball 63 will project partly into respective cutouts 67 thus creating a brake-like effect. It is further understood that the engagement of the cutouts 67 by the ball 68 coincides with the spring wiping surface 27*a* being stationed astride the groove 57*a* at the center of respective contacts 54 and 55. Thus, the spring 27 connects either the contact 54 and 56 or 55 and 56 together.

There are two sliders 63 on one side of the cover 62 controlling respective contact areas 53*a* and 53*c* and two sliders 63 on the other side thereof controlling the contact areas 53*b* and 53*d*. The cover 62 is graduated with scale numerals 77 so that the operator is aware at all times as to which contacts are connected together. The externally protruding handle 73 of the slider 63 can have a groove 74 to permit adjustment by pen point or screw driver and to serve as a marker for determining slider position with regard to the numerals of the scale 77.

The switch matrix of FIG. 8 is only one sample of many patterns that are possible. Thus, for instance, the slider 63 can be made longer than shown in FIG. 8 and be provided with a pair of springs 27 to contact simultaneously the contact areas 53*a* and 53*c* or contact areas 53*b* and 53*d*, thus converting switch function from single pole, double throw to double pole, double throw. This design varient, as well as many other variants now shown, but contemplated, will be apparent to those skilled in the art and are included in the scope of this invention.

We refer now to FIG. 10 of the drawings which shows an embodiment similar to embodiment of FIG. 1 except that the printed circuit board 12 has been eliminated altogether, with its contact pattern being reproduced on a much larger circuit board 83 containing connections for numerous circuit components 88 other than switches.

The user etches switch matrix on the board 83 in accordance with drawings furninshed by swich manufacturer and the manufacturer in addition to matrix drawings, furnishes to user switch enclosure 80 with sliders 23A and springs 27 but less the baseboard 12, the pins 15 and the contacts 14. This affords the user substantial saving in cost as the switch matrix (baseboard 12, contacts 14 and pins 15) is switch's most expensive component, eliminates soldering, permits easy replacement of worn or defective parts, provides hitherto unavailable flexibility. To permit attachment of the enclosure 80 with sliders 23A and springs 27 to the printed circuit board 83, the enclosure 80 is furnished with a pair of flanges 81 having thru holes 82 matching correspondingly locates holes 89 in the board 83. Pair of phillips head screws or other type screws 85 holds the enclosure 80 and the board 83 together with nuts 86 on the other side of the board 83. Rivets or eyelets (not shown) can be employed in lieu of the screws 85. The location of the holes 82 and 89 is such that the wiping springs 27 in sliders 23A engage consecutive contacts 114 on the board 83 without shorting them. Miniature dowel pins (not shown) protruding thru flanges 81 matching with correspondingly located holes (not shown) in the board 83 can be used for alignment if needed. It is understood that the enclosure 80 is identical to the enclosure 21 of FIG. 1, except that it is shorter in height and has flanges 81.

Figure 12:
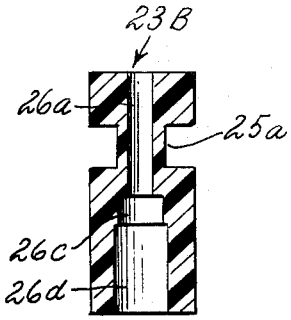
FIG. 12 is a sectional view of a modified slider design according to the invention.
Figure 11:
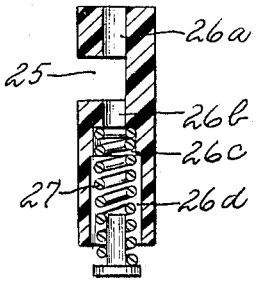
FIG. 11 is a sectional view thru slider taken along the lines 11—11 of FIG. 10.

Slit board 22 and sliders 23 are used same as in the embodiment of FIG. 1. The slider 23A shown in FIG. 11 is identical to the sliders 23 except for the thru hole 26 having varying diameter sections 23*a*, 26*b*, 26*c* and 26*d*. The spring 27 is press-fitted in the section 26*c* and protrudes freely thru section 26*d*. The diameter of the sections 26*a* and 26*b* is alike and somewhat smaller than that of the sections 26*c*. The recess 25 is on the left side of the slider 23A, it will be understood, however, by those skilled in the art, that sliders employed in the embodiments of FIGS. 1 and 10 could also use a pair of recesses 25*a* arranged symmetrically in either of the slider sides, instead of a single recess 25, the only requirement being that the material thickness between the recesses 25*a* be less than the width of the slot 24 in the baseboard 22. Such slider 23B is shown in FIG. 12.

We refer now to FIG. 13 which shows another embodiment of the invention similar to FIG. 10. A slit board 102 similar to board 22 has sliders 23A or 23B provided with spring 27 (not shown). The board 102 after being loaded with sliders 23A is wedged into grooves 103 in a respective pair of supporting walls 104 perpendicular to the board 102, forming U-shaped frame 110. The board 102 and the walls 104 can be held together by epoxy cement, press fit or other suitable means (not shown). The walls 104 have four externally protruding pins 105 mating with corresponding located holes 106 located in the center of respective contacts 114 in the PC board 83. However, only part of the contacts 114 corresponding to the contacts 14A of FIG. 1 is shown in FIG. 13, the rest being contained under the frame 110. The pins 105 are anchored within respective holes in the walls 104 by press fit, epoxy cement or other suitable means. To permit easy joining by solder of the pins 105 to respective contacts 114, as means of retaining the frame 110 in place, slots 107 are provided in the lower part of the walls 104 concentrically to the pins 105, thus providing access to the pins 105.

To install the frame 110, the user inserts the pins 105 in respective holes 106 from the printed circuit side of the board 83, presses the frame 110 against the board 83, and anchors it in place by bending the pins 105 at a 90° angle on the other side of the board 83. Subsequently, the pins 105 and the contacts 114 are soldered together on the PC side of the board 83, the solder connection being shown at 108.

The contacts 114 extend past the frame 110 as required to meet individual user needs. The gap 111 corresponds to gap 17*a* in FIG. 1, separates respective contacts 114 and can be bridged by the spring 27 (not shown) relative displacement of respective sliders 23A.

It will be understood by those skilled in the art that the embodiment of FIG. 13 is equivalent to embodiment of FIG. 1, the main difference being in removability of the frame 110.

It is seen that the sliders 23A may be numbered at 112 by silk screening, hot stamping or other suitable means as way of easy and unambiguous identification.

It will be understood by those skilled in the art that switches according to the embodiment of FIG. 3 or FIG. 13 could be considered as strips composed of individual switch sections and could be made from considerably longer strips comprised of a very larger number of sections parted to shorter length as needed.

The parting may be done by commercially available circular saw blades of 0.006 inch thickness introduced between any two sliders 39 to cut through the structure 35 of FIG. 3. It will be further understood that individual assembly parts such as sliders and walls are so dimensioned that the length of the sections is no different from what they would have been if the switch was made by a method other than parting from strip.

As an example, the length of 5 and 10 section switches is 0.494 inch and 0.994 inch respectively. If the 10 section switch is cut in half, it will yield two 5 section switches, the length of each being $$\frac{.994 - .006}{2} = \frac{.988}{2} = 0.494$$

which is exactly equal to what the length of the switch should be.

I claim:

1. A switching device adaptable to a variety of switch functions comprising in combination:

an insulating board; a plurality of conductors arranged on said board according to a predetermined, repetitive pattern separated from each other by a plurality of insulative gaps, the latter substantially narrower than the width of said conductors; an insulating cover having a rectangularly shaped flat mid-section with perpendicular sides for enclosing said conductors and said insulative gaps and for retaining said board in a spaced, parallel relationship with said midsection, said midsection having a plurality of slots located opposite said gaps, forming edges parallel to one of said sides in accordance with said conductor pattern; at least one slider having internal and external portions separated by a groove parallel to said midsection, said external portion being manually displaceable along the length of one of said slot edges, extending into said groove for the purpose of retaining said slider in said slot and for guiding its displacement therealong; said internal slider portion being located between said board and said midsection, extending to within close proximity of said conductors and having a bore perpendicular to said board and to said midsection; a spring loaded contact substantially wider than the width of said gap, protruding out of said bore, positioned by the surfaces forming said bore along the length and in conductive engagement with respective ones of said conductors coincidently to displacement of said slider along said slot edges; index means comprised of a spring loaded projection in said slider and of a plurality of indentations in said cover, said projection being adapted to protrude yieldingly into one of said indentations coincidently with said contact being stationed astride a respective pair of conductors on either side of said gap; and terminal means connected to said conductors accessible from outside of said cover.

2. The combination according to claim 1 in which said spring loaded contact comprises a conductive helical spring compressed between said conductors and said midsection.

3. The combination according to claim 2, including a rivet having a shank and a head, said shank being pushed into said spring, said head remaining in wiping engagement with respective ones of said conductors.

4. The combination according to claim 1 including mechanical connecting means for joining selected ones of said sliders together for simultaneous displacement thereof.

5. The combination according to claim 4 in which said mechanical connecting means is a pin thru said sliders.

6. The combination according to claim 1 in which said board and said cover are one integral part joined permanently together with cement.

7. The combination according to claim 1 in which said board and said cover are two separate parts including fastening means for joining said two parts together.

8. The combination according to claim 7 in which said board is considerably longer and wider than said cover including conductors printed on said board for mounting thereon components other than switches.

9. The combination according to claim 8 in which said terminal means are conductors disposed on said board.

10. The combination according to claim 9 in which said fastening means provides correspondingly located holes in said board and in said cover and screw means to hold them tightly together.

11. The combination according to claim 9 in which said fastening means provides a plurality of pins in said cover and a corresponding plurality of mating holes in said board, said pins extending thru said holes and being attached to said cover.

12. The combination according to claim 1 including following means for adapting said switch when manufactured to a desired switch function:

A. means to vary said conductor pattern by varying the location of said insulative gaps on said board;

B. means to vary the location of said slots and said indentations in said cover;

C. and means for joining selected ones of said sliders together for their simultaneous displacement along the length of their respective slots.

13. The combination according to claim 2 in which said board is made of thermosetting plastic material laminated with copper, said conductors and said gaps being obtained as a result of parting said copper into individual segments with a slitting saw.

14. The combination according to claim 2 in which said board is made of thermosetting plastic material laminated with copper, said conductors and said gaps being obtained as a result of etching part of said copper away.

15. The combination according to claim 4 in which said terminal means are evenly spaced pins connected to said conductors, arranged in mating pairs in two parallel rows, each pin in one of said rows having a melting pin in the other of said rows and in which said slots extend parallel in relation to said mating pairs.

16. The combination according to claim 1, in which said terminal means are evenly spaced pins connected to said conductors, arranged in mating pairs in two parallel rows, each pin in one of said rows having a mating pin in the other of said rows and in which said slots extend perpendicular in relation to said mating pairs.

17. The combination according to claim 1 in which said contact remains in conductive engagement at all times with at least one of said conductors.

18. The combination according to claim 1 including a recess in the external portion of said slider for inserting a pointed object therein to move said slider along the length of said slot.

19. The combination according to claim 1 including means for limiting the travel of said contact to two positions, one across said gap wherein it connects a pair of respective conductors, the other one away from said gap in contact with one of said conductors only.

20. The combination according to claim 8 providing at least one pair of jointly displaceable contacts, the travel of said contacts and the location of said gaps being so coordinated that selectively only one of said first and second contacts is stationed across said gap.

* * * * *